US005318172A

United States Patent [19]

Kenny et al.

[11] Patent Number: 5,318,172

[45] Date of Patent: Jun. 7, 1994

[54] PROCESS AND APPARATUS FOR IDENTIFICATION AND SEPARATION OF PLASTIC CONTAINERS

[75] Inventors: Garry R. Kenny, College Grove, Tenn.; David R. Morgan, Hardin, Ky.; Abdul R. Al-Ali, Dahran, Saudi Arabia

[73] Assignee: Magnetic Separation Systems, Inc., Nashville, Tenn.

[21] Appl. No.: 829,962

[22] Filed: Feb. 3, 1992

[51] Int. Cl.[5] ..... B07C 5/00

[52] U.S. Cl. ..... 209/524; 209/576; 209/580; 209/588; 250/339.01; 250/341; 250/223 B; 250/226; 356/240

[58] Field of Search ..... 209/576, 524, 577, 580–582, 209/588; 250/339, 341, 223 B, 226; 356/239, 240, 402

[56] References Cited

U.S. PATENT DOCUMENTS

| | | | |
|---|---|---|---|
| 3,411,622 | 11/1968 | Dickie . | |
| 3,454,759 | 7/1969 | Calhoun | 209/577 |
| 3,512,637 | 5/1970 | Littlefield . | |
| 3,645,391 | 2/1972 | Hirakawa et al. . | |
| 3,738,475 | 6/1973 | Lee et al. . | |
| 3,802,548 | 4/1974 | Wentz et al. . | |
| 3,814,521 | 6/1974 | Free . | |
| 3,890,221 | 6/1975 | Muehlethaler . | |
| 3,910,701 | 10/1975 | Henderson et al. . | |
| 3,939,983 | 2/1976 | Asfour . | |
| 4,010,354 | 3/1977 | Apicella et al. . | |
| 4,095,696 | 6/1978 | Sherwood . | |
| 4,146,135 | 3/1979 | Sarkar et al. . | |
| 4,175,694 | 11/1979 | Donabin . | |
| 4,176,260 | 11/1979 | Ward et al. . | |
| 4,204,950 | 5/1980 | Buford . | |
| 4,278,538 | 7/1981 | Lawrence et al. | 209/581 |
| 4,281,933 | 8/1981 | Houston et al. . | |
| 4,558,786 | 12/1985 | Labe . | |
| 4,610,359 | 9/1986 | Müller . | |
| 4,919,534 | 4/1990 | Reed | 209/582 |
| 5,134,291 | 7/1992 | Ruhl et al. . | |
| 5,141,110 | 8/1992 | Trischam et al. | 209/588 |
| 5,150,307 | 9/1992 | McCourt et al. . | |

FOREIGN PATENT DOCUMENTS

| | | | |
|---|---|---|---|
| 213364 | 9/1984 | Fed. Rep. of Germany | 209/577 |

*Primary Examiner*—H. Grant Skaggs
*Attorney, Agent, or Firm*—Mark J. Patterson; Edward D. Lanquist, Jr.; I. C. Waddey, Jr.

[57] ABSTRACT

Electromagnetic radiation is projected through various types of plastics materials such as plastic containers. The readings from the electromagnetic radiation transmitters are received by a sensor array. Plural readings are taken from each plastic bottle as it passes under the sensor. The measurements from the sensor array output are then fed into a computer. The materials are then separated into three classes. The first class contains polyvinyl chloride (PVC) and polyethylene teraphalate (PET) containers. The second class contains polypropylene (PP) and natural (primarily milk containers) high density polythylene (HDPE) containers. The third class contains opaque materials such as rigid, mixed color high density polythylene (HDPE) containers, opaque polyvinyl chloride (PVC) containers, opaque polystyrene (PS) containers, and opaque polypropylene (PP) containers. The groups of plastics contained in each of the classes are then separated out using the same or other detection means.

17 Claims, 6 Drawing Sheets

PROCESS AND APPARATUS FOR IDENTIFICATION AND SEPARATION OF PLASTIC CONTAINERS

BACKGROUND OF THE INVENTION

The present invention relates generally to a device for identification and separation of plastic containers and more particularly to a device for identification and separation of polyvinyl chloride (PVC) containers, polyethylene (PET) plastic containers, polypropylene (PP), and high density polyethylene (HDPE) containers.

It will be appreciated by those skilled in the art that conservation and recycling are generally practiced by individuals, as well as municipalities. Municipalities are determining way to recycle materials such as plastic bottles in a cost effective manner. In recycling plastic containers, polyvinyl chloride (PVC) containers, polyethylene (PET) containers, polypropylene (PP) and high density polyethylene (HDPE) containers containers must be sorted and separated. Failure to separate these containers prior to the chemical recycling of the containers can create a bad mix, requiring the batch to be discarded without the benefits of recycling. To this end, there have been several attempts to provide a process and apparatus for identification and separation of plastic containers.

What is needed, then, is a process and apparatus for identification and separation of plastic containers. This process and apparatus must be able to identify and separate plastic containers at a high rate of speed. This process and apparatus must be cost effective. This process and apparatus must be accurate. This process and apparatus is presently lacking in the prior art.

SUMMARY OF THE INVENTION

In the present process and apparatus, electromagnetic radiation is projected through various types of plastics materials such as plastic containers. The readings from the electromagnetic radiation transmitters are received by a sensor array. Plural readings are taken from each plastic bottle as it passes under the sensor. The measurements from the sensor array output are then fed into a computer. The materials are then separated into three classes. The first class contains polyvinyl chloride (PVC) and polyethylene teraphalate (PET) containers. The second class contains polypropylene (PP) and natural (primarily milk containers) high density polythylene (HDPE) containers. The third class contains opaque materials such as rigid, mixed color high density polythylene (HDPE) containers, opaque polyvinyl chloride (PVC) containers, opaque polystyrene (PS) containers, and opaque polypropylene (PP) containers. The groups of plastics contained in each of the classes are then separated out using the same or other detection means.

Accordingly, one object of the present invention is to provide a process and apparatus for identification and separation of plastic containers.

Still another object of the present invention is to provide a process and apparatus which can be configured for a variety of separation and capacity requirements.

Still another object of the present invention is to provide a process and apparatus which identifies the primary container plastic type while ignoring labels, residue contamination, closures and opaque container bottoms.

Still another object of the present invention is to provide a process and apparatus which is accurate yet cost effective.

DESCRIPTION OF THE PREFERRED EMBODIMENT

Figure 1:
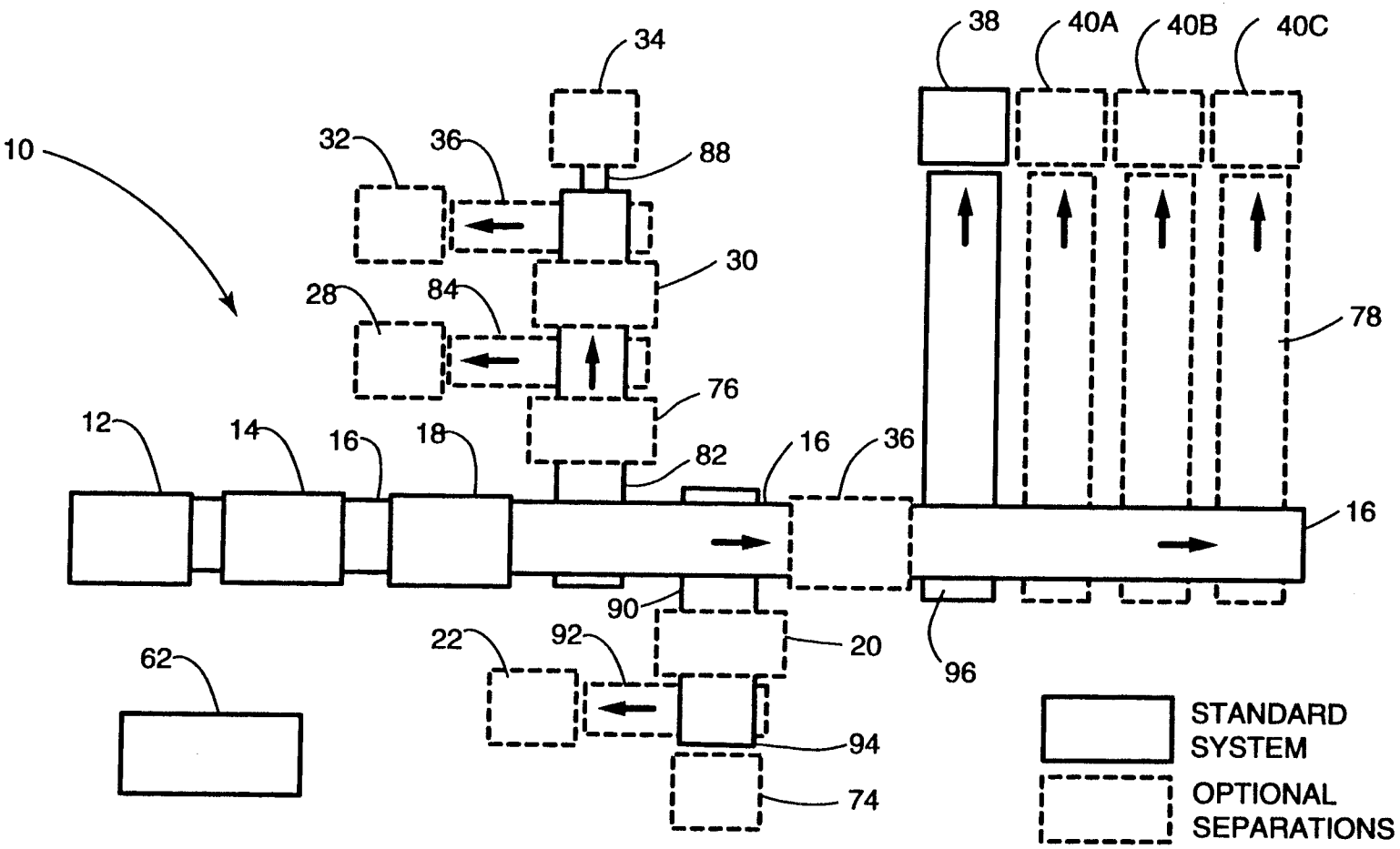
FIG. 1 is a block diagram of the preferred embodiment of the process and apparatus for identification and separation of plastic containers.
Figure 2:
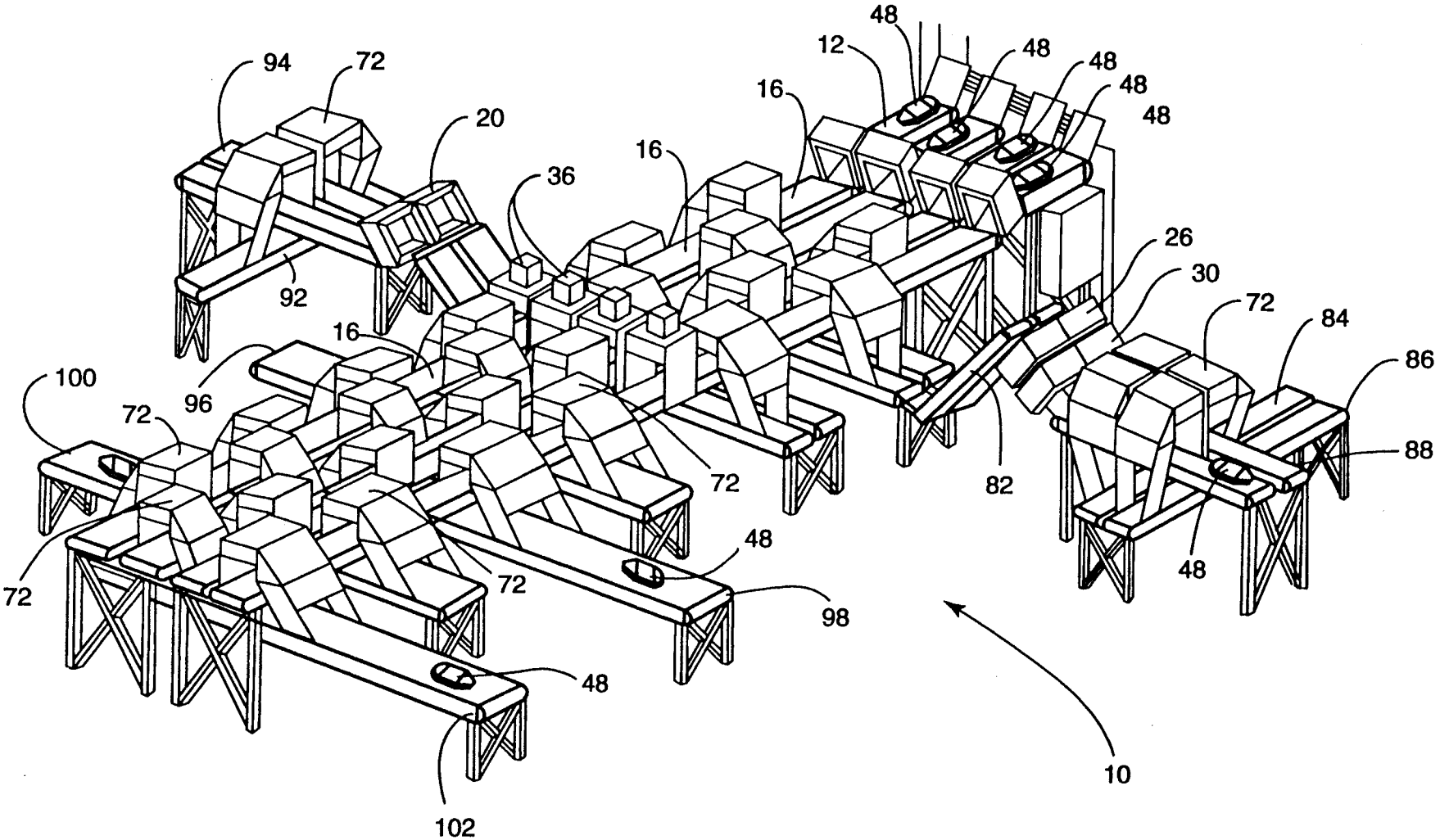
FIG. 2 is a perspective view of plastic separation system of the present invention.

Referring now to FIGS. 1 and 2, there is shown generally at 10 the apparatus for identification and separation of plastic containers of the preferred embodiment. Plastic containers 48 are placed on feed conveyor 12. Plastic containers 48 then pass through primary detection module 18. In primary detection module 18, electromagnetic radiation between wave lengths of 800 and 1000 nanometers is directed through plastic containers. The electromagnetic radiation is then received by an electromagnetic receiver array. The change in intensity of the electromagnetic radiation when the plastic container is interposed between the transmitter and receiver is used to determine the type of plastic container. Readings from primary detection module 18 are fed through a computer and central control panel 62 Which analyzes the change in intensity of the electromagnetic radiation received by the electromagnetic receiver array which sends messages to the conveyor system to direct the bottle in one of three directions. If the amplified voltage output of the electromagnetic radiation receiver is say 10 volts when no container is present then a change from 10 volts to 8 volts would indicate the presence of Class 1 plastic material, polyethylene terephalate (PET) plastic and polyvinyl chloride (PVC). If the sensor output signal is between 8 and 1 volts, the materials will fall in Class 2, comprising polypropylene (PP) plastic or natural high density (HDPE) plastic. If the sensor output signal is less than 1 volt or near 0 volts, the plastic material will fall within Class 3, which comprises opaque, rigid, mixed color (HDPE), opaque PVC, opaque PS, and opaque polypropylene.

The materials in Class 1 will then be sent down off PVC/PET conveyor 82 through PVC module 26 which will separate the PVC in Class 1 materials onto PVC conveyor 84 into PVC container 28 leaving colored PET to travel down color PET conveyor 86 to the color PET module 30. Color PET module 30 will place colored PET plastic into color PET container 32 leaving clear PET to continue down clear PET conveyor 88 to clear PET container 34. If the material falls within Class 2, PP/HDPE dairy conveyor 90 passes the material through polypropylene module 20 to separate the polypropylene plastics from the natural or dairy HDPE plastics. The polypropylene plastics are moved down PP conveyor 92 and placed in polypropylene container 22 based upon readings from polypropolene module 20. The remaining natural HDPE plastic materials are run down dairy HDPE conveyor 94 to natural HDPE container 74.

If the materials fall within Class 3, conveyor 16, based upon instructions from microprocessor 62, sends Class 3 materials through color detection module 36. Based upon readings from color detection module 36, mixed color HDPE's are moved down mixed color conveyor 96 and placed in mixed color HDPE container 38. Otherwise, colored HDPE materials are placed in their appropriate colored HDPE containers 40*a*, 40*b*, 40*c*, respectively by mixed color conveyors 98, 100, 102.

In the preferred embodiment, electromagnetic radiation having the wave lengths of substantially 600 to 700 nanometers is used to differentiate between colored PET and clear PET which is used in colored PET module 30.

In the preferred embodiment, electromagnetic radiation having a wave length of between substantially 200 to 400 nanometer wave length is used to differentiate between PET (colored and clear) and clear PVC.

In the preferred embodiment, PP module 20 uses an electromagnetic radiation wave length of between substantially 200 and 400 nanometers to differentiate between natural HDPE and polypropylene. This range of wave length also distinguishes between mono-layer polypropylene and multi-layer polypropylene. In the alternative, in the preferred embodiment, electromagnetic radiation having a wave length between substantially 600 and 700 nanometers can be used to distinguish between mono-layer polypropylene and natural dairy HDPE.

Figure 3:
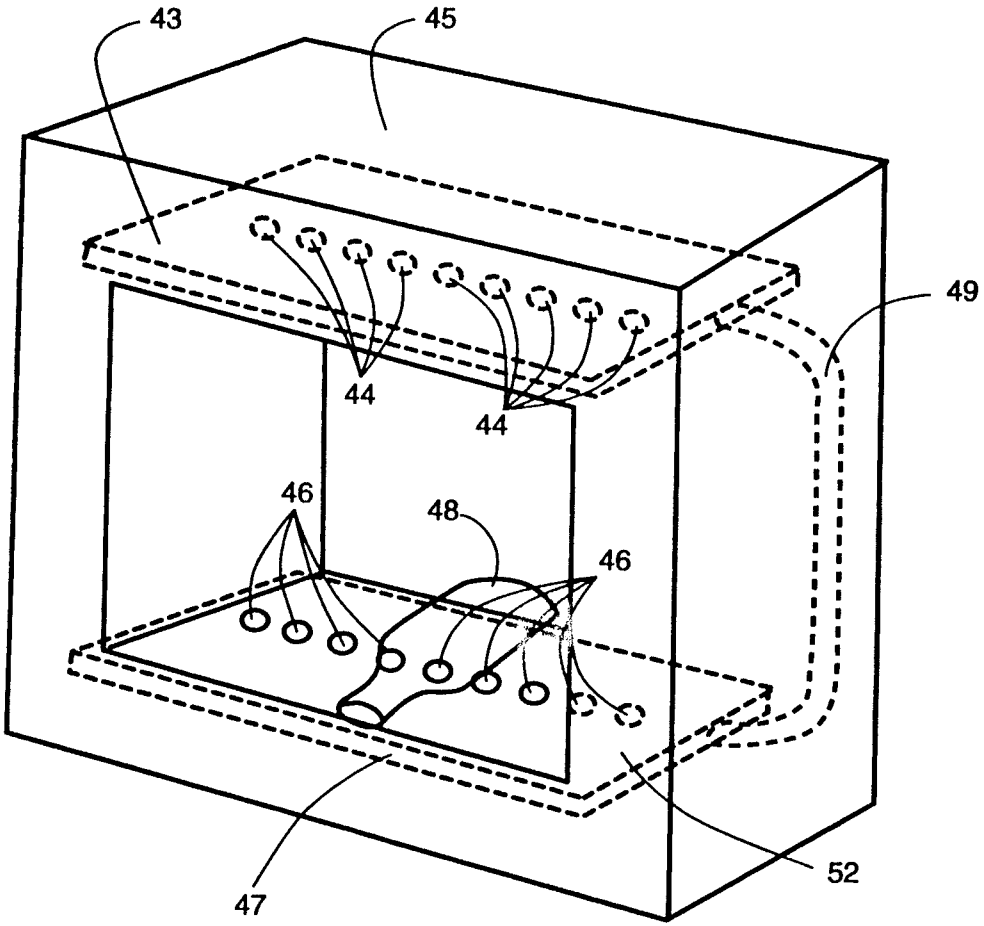
FIG. 3 is a perspective view of linear array.
Figure 5:
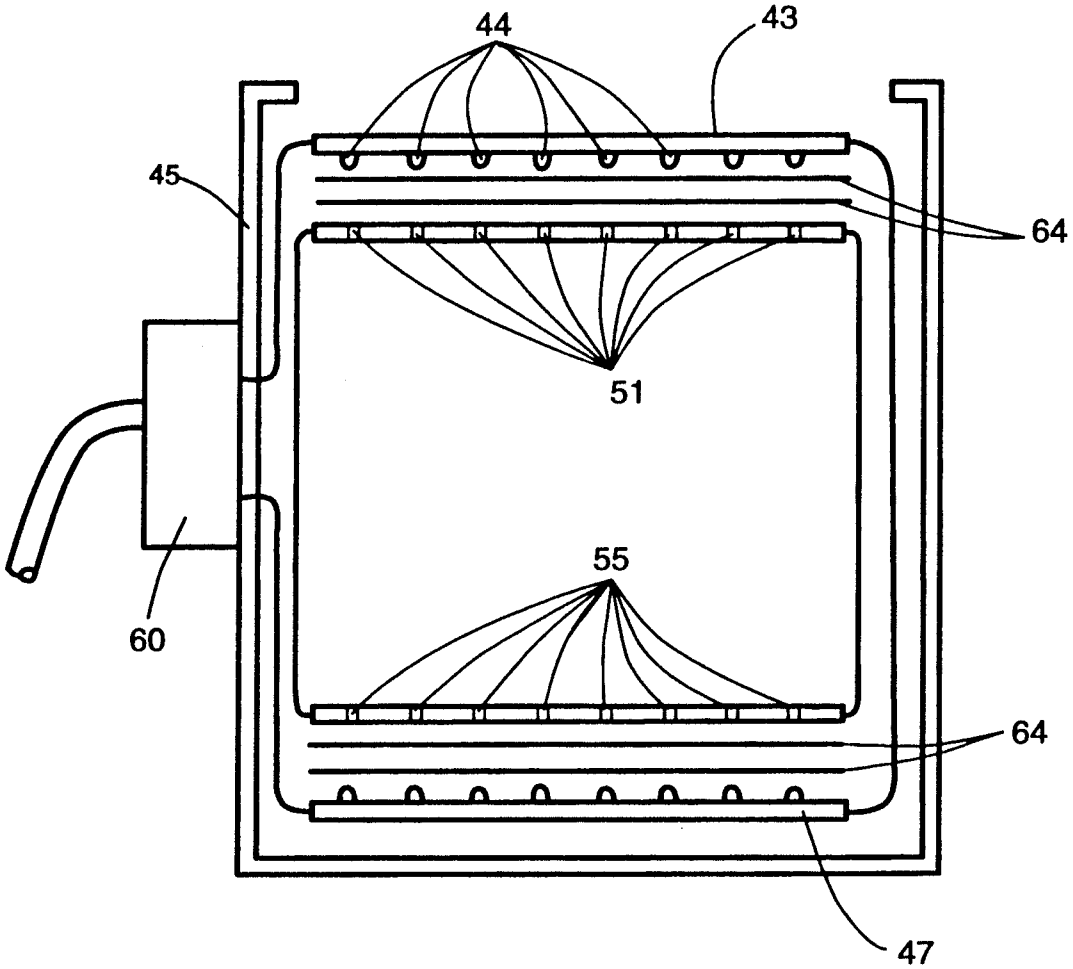
FIG. 5 is a frontal view of the receiver array having baffles.

A single transmitter/receiver unit 42 can be used to make the required measurements. However, in the preferred embodiment, as shown in FIGS. 3 and 5, plastic containers 48 pass through perpendicularly to the line of array formed by transmitter 44 and receiver 46. In the preferred embodiment, elements of the array are spaced substantially ¼ inch to 1 inch apart. Measurements of the transmitter radiation intensity are then made every 1 to 5 milliseconds. In this manner, many areas of container 48 can be examined for transmitted radiation intensity. The measurements are then stored in a memory device such as random access memory (RAM) integrated circuits 50. After container 48 passes through array 44, 46, computer program in computer 52 is used to examine the stored data. The readings to be examined by the computer program are identified by flagging those readings which decrease below the sensor voltages with no container present. The threshold sensor voltage is set by communicating with the microprocessor through a host computer via a serial communication connection. The required sensor threshold voltages are determined empirically by passing a number of different types of plastic container through the sensor and determining what voltage corresponds to a split between different types of plastic. The readings are taken either across a row of readings or down a column of array readings. The number of measurements required in each of the intensity levels for a decision can be set by communicating with the program through a host computer. If the number of readings matches or is greater than the set value, the container is identified as that class of container.

In the prefered embodiment, housing 45 is constructed from stainless steel. LED transmitters 44 tranmits through holes in housing to photodiode receivers 46 aligned with other holes. Transmitter 44 is controlled by circuit board 43 having servo drive circuit which runs LED's. Circuit board 47 contains amplifiers for the photodiodes, peak detector, and microprocessor 52. Cables 49 connects circuit boards 43, 50.

Some of the measurements taken from the container may come from postions along the edges of container 48. These readings should be ignored, because the electromagnetic radiation is not passing through container material skin perpendicularly and may give an invalid sensor output signal. These edge readings are determined by the computer program by sequentially scanning the reading array in memory and noting which readings are the first to decrease below the no bottle sensor voltage level. Further along in the scan across the stored sensor voltage array, those readings which are last before a no bottle reading are also ignored. The reading hierarchy method makes the identification more accurate by allowing readings taken at the edges of the container to be ignored.

Figure 4:
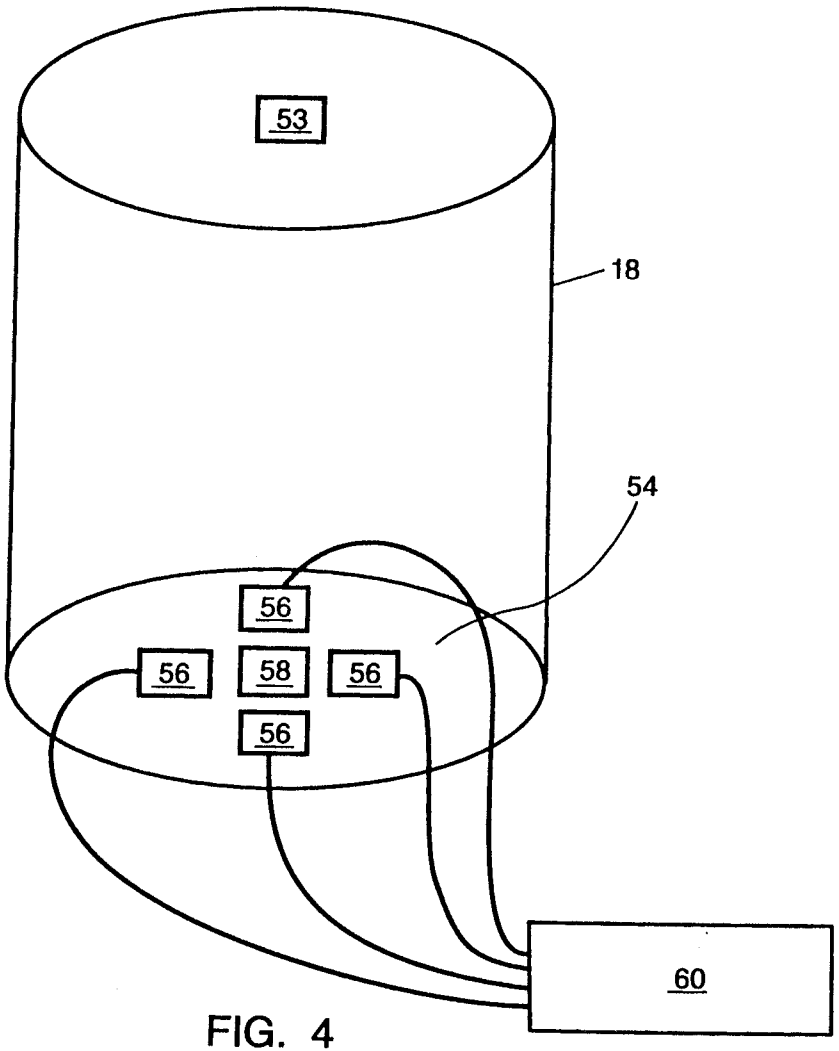
FIG. 4 is a top view of the 5-element array.

As shown in FIG. 4, and alternate method can be used to ignore the effect of container edges and holes in containers. Detection module 18 can be fabricated from a closely spaced 5-element unit 54. Four elements 56 surround central element 58, the output of which is used to determine the density of the transmitted light. Outside elements 56 are used to determine the presence of plastic container 48. If elements 56 do not indicate the presence of plastic container 48, then the signal from central element 58 is not used. This may be accomplished by using the signal from outside elements 56 to inhibit the output signal from central element 58 or by providing the signal from outside elements 56 to a microprocessor input port 60 to inhibit reading of central unit 58. Sensor unit 54 would be actuated and read every 1 to 5 milliseconds. Photodiodes 56, 58 would receives tranmission from transmitter 53.

Data collected from sensor 54 would not contain edge effects, thereby simplifying the microprocessor program. A hardware solution could be used in place of microprocessor 62 with array 54, 53 providing the information. This would require comparative sets at each level of reference for the different classes. Each array would send a signal to a comparator reference for each classification. The output of the comparators would latch high and low, depending on the logic circuit, upon arrival of a signal voltage greater than the reference. The outputs of the comparators would go to logic circuitry which would yield the highest output only. For single array configuration, this output would be the container's classification. For multiple arrays, each array output would read with the highest output making determining of the class. The comparator latches would then be reset for the next container.

In addition, the elements which determine the presence of an edge can be quite close to each other, on the order of 0.10 inch. Thus, a reading can be made much closer to the edge than with the 0.75 inch spacing of the preferred embodiment.

The data stored in memory is proportional to the area of the container, if the container speed through the array is relatively constant, since the distance between array elements if fixed, and the time between measurements is constant. Thus, the number of measurements for a specific plastic container is proportional to the area of the container. The identification accuracy can be improved by using the area of the container to modify the number of measurements required for the identification.

Identification can be made more accurate, particularly for containers with much of the inner surface covered with residual contents, by examining the array readings which were previously classified as edge readings (bottle, label, closures, or bottoms). If the edge reading is the same as the next array reading inside the perimeter of the container as defined by the position of the edge readings, then the edge reading can be counted on as a valid reading for that particular type of plastic. Alternately, the edge reading can be discounted as a partial count, the weight of which is increased as the number of valid readings decreases.

The decision program can be improved by adding the ability to "learn". Several hundred containers can be passed through an array. The program is "told" what kind of plastic container is being used. The program then goes through a routine whereby the voltage threshold for each class of plastics are varied until the number of readings for each type of plastic are maximized. Then the program stores those threshold voltage settings. Next, the program varies the number of required number of readings within each voltage threshold until the number of correct classifications for each type of plastic container is maximized. The required number is then stored. The program then prints out the voltage threshold settings and the required number of readings for examination.

The number of measurements that can be taken across the container depends upon the number of transmitter/-receiver elements that make up the sensor array. Generally, when elements are placed within two inches of each other, light from one transmitter will illuminate receiver elements on either side of the intended receiver. When a container is read, the stray light can cause incorrect readings, since a portion of light is coming through a different area of the container. To narrow the sensor arrays, as shown in FIG. 5, baffles 64 are used to separate receivers 46 in array 45. Baffles 64 reduce the interference effect. Spacing of receivers 47 of ¼ inch to ¾ inch creates stray light that accounts for up to 25% of the received light. The stray light can further be overcome by pulsing transmitters 44 sequentially. Every fourth transmitter 44 is alternately pulsed and read by the receiver. Then the next four transmitters are pulsed, and so on, until all receivers 46 are read. Each pulse lasts approximately 100 microseconds and is repeated, in sequence, after a delay of approximately 25 microseconds. Transmission from tranmitter 44 passes through holes 51 and through holes 55 respectively and is received by receiver 47.

The method by which container 48 is presented to sensor array 44 is important to achieve the maximum number of readings available. An orthoganol presentation of the container 48 to array 45 provides the most linear results. This allows different receiver rate configurations to be used with different presentation methods. Any array configuration can be used with any presentation.

Some presentation methods are more easily incorporated in specific array configurations. Sensors do not have to be vertical and read containers on a horizontal plane. Bottles cann be dropped through sensors. This method receives more radial information about container 48 than does a horizontal array. Further, this method provides some orientation of container.

Figure 7:
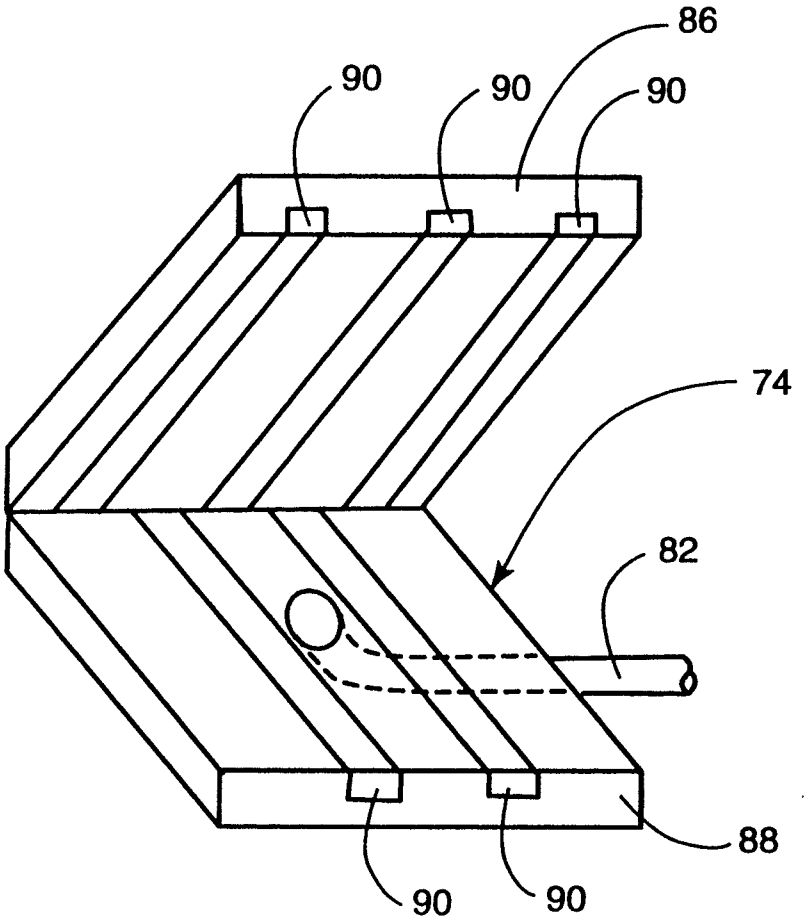
FIG. 7 is a perspective view of the flippers.
Figure 6:
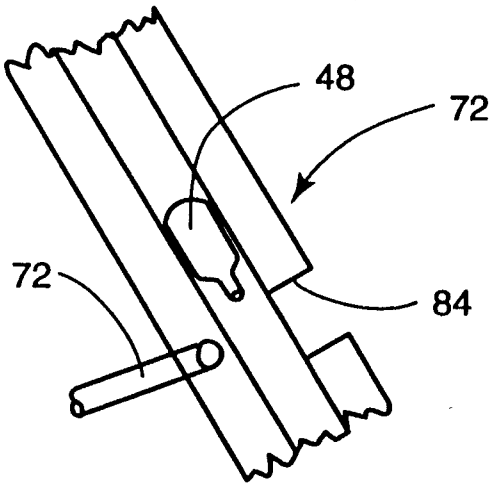
FIG. 6 is a perspective view of the air jets.

Identification information on container 48 is used to separate the container classes into streams. A conveyor line can be used to transport container 4 (after subsequent identification of container 48 has been made. There are mechanical means for removal of the container from conveyor 16 into its appropriate classification. This can be done through use of air jets 72 as shown in FIG. 6, or mechanical flippers 74 as shown in FIG. 7. In the preferred embodiment, air jets 72 are used to transport containers 48 into off bearing conveyor 76. In the preferred embodiment, flippers 74 or mechanical gates can be used to remove container 48 into off bearing conveyors 76 or chutes 78. Although FIG. 1 shows one specific separation and sorting device and method, an infinite number can be used by placing off bearing conveyors 76 in various configurations to provide virtually a unlimited number of classifications.

Timing signals from the point of container identification are used to determine the correct point in time for the activation of the corresponding removal assembly. These timing signals are generated by microprocessor 62. Timing signals depend upon the velocity of conveyor 16, velocity of container 48 in a slide or in free fall, the distance from the identification point to the removal assembly, the size of the container, and the mechanical delay of the removal assembly (air jets 72 or flippers 74).

As can be seen in FIGS. 6 and 7, an alternative method for separation can be done without the use of transport conveyor 76 without need for transport conveyor 80. This method uses air jets 72 or flippers or gates 74 to propel containers 48 into off bearing conveyors (76 in FIG. 1) or chutes (78 in FIG. 1) immediately after identification. In both mechanisms, air hose 82 directs air to operate device. In FIG. 6, air jet 82 forces container 48 through opening 84. In FIG. 7, air jet 82 forces upper jaw 86 away from lower jaw 88 to force container (48 in FIGS. 2, 3, and 6) off conveyor. Outlets 90 direct air. This method is probably limited to three classifications of containers. Two removal assemblies are placed in opposition to one another after the sensor assembly slide. This allows two classifications of containers to be positively propelled in opposite directions and onto conveyors or hoppers. The third class is passively removed by inaction of either of the two removal assemblies. The third class will fall into the appropriately placed conveyor or hopper. Again, timing signals for activation of the removal assembly is integral for proper separation to take place.

Thus, although there have been described particular embodiments of the present invention of a new and useful Process and Apparatus for Identification and Separation of Plastic Containers, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An apparatus for classifying a plastic container comprising:

a. means to project unpolarized electromagnetic radiation through said plastic container;

b. means to receive said unpolarized electromagnetic radiation projected through said plastic container;

c. means to determine the difference in intensity between the projected unpolarized electromagnetic radiation and the received unpolarized electromagnetic radiation;

d. said unpolarized electromagnetic radiation is projected at wavelengths of substantially 800 to 1000 nanometers; and e. said means to determine the difference in intensity between the projected unpolarized electromagnetic radiation and the received unpolarized electromagnetic radiation is used to classify said plastic containers in Class 1, Class 2, or Class 3 materials, wherein Class 1 consists of polyvinyl chloride and polyethylene teraphalate, Class 2 consists of polypropylene and natural high density polyethylene, and Class 3 consists of rigid and mixed color high density polyethylene, opaque polyvinyl chloride, opaque polystyrene, and opaque polypropylene.

2. An apparatus for classifying a plastic container comprising:

a. means to project unpolarized electromagnetic radiation through said plastic container;

b. means to receive said unpolarized electromagnetic radiation projected through said plastic container;

c. means to determine the difference in intensity between the projected unpolarized electromagnetic radiation and the received unpolarized electromagnetic radiation;

d. said unpolarized electromagnetic radiation is projected at wavelengths of substantially 600 to 700 nanometers;

e. said plastic container selected from a group consisting of clear polyethylene plastic, green polyethylene plastic, amber polyethylene plastic, clear polyvinyl chloride plastic, and clear polypropylene plastic; and f. said means to determine the difference in intensity between the projected unpolarized electromagnetic radiation and the received unpolarized electromagnetic radiation is used to classify said plastic container as clear polyethylene plastic, green polyethylene plastic, amber polyethylene plastic, clear polyvinyl chloride plastic, or clear polypropylene plastic.

3. An apparatus for classifying a plastic container comprising:

a. means to project unpolarized electromagnetic radiation through said plastic container;

b. means to receive said unpolarized electromagnetic radiation projected through said plastic container;

c. means to determine the difference in intensity between the projected unpolarized electromagnetic radiation and the received unpolarized electromagnetic radiation;

d. said unpolarized electromagnetic radiation is projected at wavelengths of substantially 200 to 400 nanometers;

e. said plastic container selected from a group consisting of HDPE dairy container and polypropylene; and f. said means to determine the difference in intensity between the projected unpolarized electromagnetic radiation and the received unpolarized electromagnetic radiation is used to classify said plastic container as HDPE dairy container or polypropylene.

4. A method for classifying a plastic container comprising:

a. projecting unpolarized electromagnetic radiation through said plastic container;

b. receiving said unpolarized electromagnetic radiation projected through said plastic container;

c. determining the difference in intensity between the projected unpolarized electromagnetic radiation and the received unpolarized electromagnetic radiation;

d. said unpolarized electromagnetic radiation is projected at wavelengths of substantially 800 to 1000 nanometers; and e. classifying said plastic containers in Class 1, Class 2, or Class 3 materials using said determined difference, wherein Class 1 consists of polyvinyl chloride chloride and polyethylene teraphalate, Class 2 consists of polypropylene and natural high density polyethylene, and Class 3 consists of opaque plastics.

5. A method for classifying a plastic container comprising:

a. projecting unpolarized electromagnetic radiation through said plastic container;

b. receiving said unpolarized electromagnetic radiation projected through said plastic container;

c. determining the difference in intensity between the projected unpolarized electromagnetic radiation and the received unpolarized electromagnetic radiation;

d. said unpolarized electromagnetic radiation is projected at wavelengths of substantially 600 to 700 nanometers;

e. said plastic container selected from a group consisting of clear polyethylene plastic, green polyethylene plastic, amber polyethylene plastic, clear polyvinyl chloride plastic, and clear polypropylene plastic; and f. classifying said plastic container as clear polyethylene plastic, green polyethylene plastic, amber polyethylene plastic, clear polyvinyl chloride plastic, or clear polypropylene plastic using said determined difference.

6. A method for classifying a plastic container comprising:

a. projecting unpolarized electromagnetic radiation through said plastic container;

b. receiving said unpolarized electromagnetic radiation projected through said plastic container;

c. determining the difference in intensity between the projected unpolarized electromagnetic radiation and the received unpolarized electromagnetic radiation;

d. said unpolarized electromagnetic radiation is projected at wavelengths of substantially 200 to 400 nanometers;

e. said plastic container selected from a group consisting of HDPE dairy container and polypropylene; and f. classifying said plastic container as HDPE dairy container or polypropylene using said determined difference.

7. An apparatus for separating and classifying plastic containers comprising:

a. means to classify each of said plastic containers into one of three classes comprising class 1, class 2, and class 3 by determining the change in electromagnetic radiation projected through each of said plastic containers;

b. means to divert each of said class 1 plastic containers;

c. means to classify each of said class 1 plastic containers by type by determining the change in electromagnetic radiation projected through each of said class 1 plastic containers;

d. means to divert each of said class 2 plastic containers;

e. means to classify each of said class 2 plastic containers by type by determining the change in electromagnetic radiation projected through each of said class 2 plastic containers;

f. means to divert each of said class 3 plastic containers; and g. means to classify each of said class 3 plastic containers by type by determining the change in electromagnetic radiation projected through each of said class 3 plastic containers.

8. The apparatus of claim 7 wherein said means to classify each of said plastic containers into one of three classes comprising class 1, class 2, and class 3 by determining the change in electromagnetic radiation projected through each of said plastic containers comprises:

a. a transmitter array for projecting said electromagnetic radiation;

b. said electromagnetic radiation is projected at wavelengths of substantially 800 to 1000 nanometers;

c. a sensor array for receiving electromagnetic radiation passing through said plastic container; and d. an electronic circuit for measuring the difference in radiation passing through said plastic bottles.

9. The apparatus of claim 7 wherein said means to classify each of said class 1 plastic containers by type by determining the change in electromagnetic radiation projected through each of said class 1 plastic containers comprises:

a. a transmitter array for projecting said electromagnetic radiation;

b. said electromagnetic radiation is projected at wavelengths of substantially 200 to 400 nanometers;

c. a sensor array for receiving electromagnetic radiation passing through said plastic container; and d. an electronic circuit for measuring the difference in radiation passing through said plastic bottles.

10. The apparatus of claim 7 wherein said means to classify each of said class 2 plastic containers by type by determining the change in electromagnetic radiation projected through each of said class 1 plastic containers comprises:

a. a first transmitter array for projecting said electromagnetic radiation;

b. said electromagnetic radiation from said first transmitter array is projected at wavelengths of substantially 200 to 400 nanometers;

c. a second transmitter array for projecting said electromagnetic radiation; and d. said electromagnetic radiation of said second transmitter array is projected at wavelengths of substantially 600 to 700 nanometers;

e. a first sensor array for receiving electromagnetic radiation passing through said plastic container from said first transmitter array; and f. a first electronic circuit for measuring the difference in radiation passing through said plastic bottles to said first sensor array;

g. a second sensor array for receiving electromagnetic radiation passing through aid plastic container from said second transmitter array; and h. a second electronic circuit for measuring the difference in radiation passing through said plastic bottles to said second sensor array.

11. The apparatus of claims 8, 9, or 10 wherein each of said sensors comprises a five element sensor.

12. The apparatus of claims 8, 9, or 10 wherein each of said sensors comprises a linear sensor array.

13. The apparatus of claims 8, 9, or 10 wherein each of said sensors comprises a linear sensor array having baffles.

14. An apparatus for classifying a plastic container comprising:

a. means to project unpolarized electromagnetic radiation through said plastic container;

b. means to receive said unpolarized electromagnetic radiation projected through said plastic container;

c. means to determine the difference in intensity between the projected unpolarized electromagnetic radiation and the received unpolarized electromagnetic radiation;

d. said electromagnetic radiation is projected at wavelengths of substantially 600 to 700 nanometers; and e. said means to determine the difference in intensity between the projected electromagnetic radiation and the received electromagnetic radiation is used to classify said plastic container as clear polyethylene plastic, green polyethylene plastic, amber polyethylene plastic, clear polyvinyl chloride plastic, or clear polypropylene plastic.

15. An apparatus for classifying a plastic container comprising:

a. means to project unpolarized electromagnetic radiation through said plastic container;

b. means to receive said unpolarized electromagnetic radiation projected through said plastic container;

c. means to determine the difference in intensity between the projected unpolarized electromagnetic radiation and the received unpolarized electromagnetic radiation;

d. said electromagnetic radiation is projected at wavelengths of substantially 200 to 400 nanometers; and e. said means to determine the difference in intensity between the projected electromagnetic radiation and the received electromagnetic radiation is used to classify said plastic container as HDPE dairy container or polypropylene.

16. A method for classifying a plastic container comprising:

a. projecting unpolarized electromagnetic radiation through said plastic container;

b. receiving said unpolarized electromagnetic radiation projected through said plastic container;

c. determining the difference in intensity between the projected unpolarized electromagnetic radiation and the received unpolarized electromagnetic radiation;

d. said unpolarized electromagnetic radiation is projected at wavelengths of substantially 600 to 700 nanometers; and e. classifying said plastic container as clear polyethylene plastic, green polyethylene plastic, amber polyethylene plastic, clear polyvinyl chloride plastic, or clear polypropylene plastic using said determined difference.

17. A method for classifying a plastic container comprising:

a. projecting unpolarized electromagnetic radiation through said plastic container;

b. receiving said unpolarized electromagnetic radiation projected through said plastic container;

c. determining the difference in intensity between the projected unpolarized electromagnetic radiation and the received unpolarized electromagnetic radiation;

d. said unpolarized electromagnetic radiation is projected at wavelengths of substantially 200 to 400 nanometers; and e. classifying said plastic container as HDPE dairy container or polypropylene using said determined difference.

* * * * *

UNITED STATES PATENT AND TRADEMARK OFFICE

CERTIFICATE OF CORRECTION

PATENT NO. : 5,318,172

DATED : February 3, 1992

INVENTOR(S) : Kenny et al

It is certified that error appears in the above-indentified patent and that said Letters Patent is hereby corrected as shown below:

Column 1, line 12, please add --terephthalate-- before "(PET)".

Column 1, line 21, please add --terephthalate-- before "(PET)".

Column 1, line 48, please change "teraphalate" to --terephthalate--.

On the title page, item [57],

On line 9, please change "teraphalate" to --terephthalate--.

On line 12, please change "polythylene" to --polyethylene--.

On line 14, please change "polythylene" to --polyethylene--.

Column 1, line 51, please change "polythylene" to --polyethylene--.

Column 1, line 53, please change "polythylene" to --polyethylene--.

Column 2, line 45, please change "terephalate" to --terephthalate--.

Column 2, line 67, please change "polypropolene" to --polyethylene--.

UNITED STATES PATENT AND TRADEMARK OFFICE

CERTIFICATE OF CORRECTION

PATENT NO. :5,318,172
DATED :February 3, 1992
INVENTOR(S) :Kenny, et al

It is certified that error appears in the above-indentified patent and that said Letters Patent is hereby corrected as shown below:

Column 7, line 10, please change "teraphalate" to --terephthalate--.

Column 7, line 37, please add --terephthalate-- after "polyethylene".

Column 7, line 38, please add --terephthalate-- after "green polyethylene".

Column 7, line 38, please add --terephthalate-- after "amber polyethylene".

Column 8, line 29, please add --terephthalate-- after "clear polyethylene".

Column 8, lines 29-30, please add --terephthalate-- after "green polyethylene".

Column 8, line 30, please add --terephthalate-- after "amber polyethylene".

Column 8, lines 33-34, please add --terephthalate-- after "clear polyethylene".

Column 8, line 34, please add --terephthalate-- after "green polyethylene".

UNITED STATES PATENT AND TRADEMARK OFFICE

CERTIFICATE OF CORRECTION

PATENT NO. :5,318,172

DATED :February 3, 1992

INVENTOR(S) :Kenny et al

It is certified that error appears in the above-indentified patent and that said Letters Patent is hereby corrected as shown below:

Column 8, line 35, please add --terephthalate-- after "amber polyethylene".

Column 8, line 28, please add --terephthalate-- after "clear polyethylene".

Column 8, line 28, please add --terephthalate-- after "green polyethylene".

Column 8, line 29, please add --terephthalate-- after "amber polyethylene".

Column 8, line 63, please add --terephthalate-- after "clear polyethylene".

Column 8, line 63, please add --terephthalate-- after "green polyethylene".

Column 8, line 64, please add --terephthalate-- after "amber polyethylene".

Signed and Sealed this

Fourth Day of October, 1994

*Attest:*

Bruce Lehman

BRUCE LEHMAN

*Attesting Officer*

*Commissioner of Patents and Trademarks*